US010183373B2

(12) United States Patent
Labelle et al.

(10) Patent No.: US 10,183,373 B2
(45) Date of Patent: Jan. 22, 2019

(54) TOOL FOR HONING AN EXTERNAL SURFACE OF A RIGHT CYLINDRICAL TUBE AND METHOD OF USE

(71) Applicant: MESSIER-BUGATTI-DOWTY, Velizy Villacoublay (FR)

(72) Inventors: Normand Labelle, Sainte Anne des Plaines (CA); Alan Caceres, Bois-des-Filion (CA); Nhu Nguyen, Montréal (CA)

(73) Assignee: MESSIER-BUGATTI-DOWTY, Velizy Villacoublay (FR)

( * ) Notice: Subject to any disclaimer, the term of this patent is extended or adjusted under 35 U.S.C. 154(b) by 142 days.

(21) Appl. No.: 15/003,382

(22) Filed: Jan. 21, 2016

(65) Prior Publication Data

US 2016/0214229 A1 Jul. 28, 2016

(30) Foreign Application Priority Data

Jan. 23, 2015 (FR) ..... 15 50558

(51) Int. Cl.
*B24B 33/08* (2006.01)
*B24B 33/10* (2006.01)
(Continued)

(52) U.S. Cl.
CPC ..... *B24B 33/08* (2013.01); *B24B 5/04* (2013.01); *B24B 33/04* (2013.01); *B24B 33/081* (2013.01); *B24B 33/083* (2013.01); *B24B 33/105* (2013.01)

(58) Field of Classification Search
CPC ..... B08B 9/023; B24B 5/04; B24B 5/047; B24B 5/425; B24B 5/426; B24B 33/04;
(Continued)

(56) References Cited

U.S. PATENT DOCUMENTS 2,162,187 A * 6/1939 Tharp ..... B24B 33/04 451/181
2,238,326 A * 4/1941 Indge ..... B24B 33/081 451/150
(Continued)

FOREIGN PATENT DOCUMENTS

CN 102 909 645 B 10/2014
DE 30 08 606 A1 9/1981
(Continued)

OTHER PUBLICATIONS

French Preliminary Search Report for 15 50558 dated Nov. 17, 2015.

*Primary Examiner* — Timothy V Eley
(74) *Attorney, Agent, or Firm* — Sughrue Mion, PLLC

(57) ABSTRACT

A honing tool (1) for honing a cylindrical external surface (2) of a rod (3). The tool comprises a plurality of honing inserts (4), adapted to hone a metal, and a support (5) for the honing inserts. The inserts (4) are carried by the support (5) and define a passage (6) around which the inserts (4) are to be found and in which the cylindrical external surface (2) of the rod (3) is insertable. The tool (1) includes a plurality of sliding skids (7) carried by the support (5), the sliding skids (7) and the honing inserts (4) being arranged to be capable of coming simultaneously into contact against the cylindrical external surface (2) of the rod (3) when the rod is placed inside the passage (6) and so as to be able to center the cylindrical external surface (2) inside the passage (6).

11 Claims, 6 Drawing Sheets

(51) Int. Cl.
*B24B 5/04* (2006.01)
*B24B 33/04* (2006.01)

(58) Field of Classification Search
CPC ... B24B 33/081; B24B 33/083; B24B 33/084; B24B 33/086; B24B 33/105; B24B 23/02
See application file for complete search history.

(56) References Cited

U.S. PATENT DOCUMENTS 2,349,628 A * 5/1944 Kline ..... B24B 33/081 451/156
2,603,044 A * 7/1952 Brandt ..... B24B 33/04 451/474
2,911,768 A * 11/1959 Peden ..... B24B 33/08 451/464
4,449,328 A * 5/1984 Gillette ..... B24B 33/081 451/180
5,341,603 A * 8/1994 Pollock ..... B24B 5/423 451/180
6,553,601 B1 4/2003 Major
6,698,048 B1 3/2004 Greene
8,613,642 B2 * 12/2013 Bowles ..... B24B 9/007 15/104.04
9,233,447 B2 * 1/2016 Shortridge, Sr. ..... B24B 5/047
9,815,169 B2 * 11/2017 Byrn ..... B24B 33/086
2003/0207657 A1 * 11/2003 Domanski ..... B24B 33/081 451/482
2011/0045746 A1 2/2011 Bowles et al.
2015/0335143 A1 * 11/2015 Edmond ..... B08B 9/027 15/88

FOREIGN PATENT DOCUMENTS

DE 34 40 350 A1 5/1986
DE 88 14 248 U1 1/1989

* cited by examiner

TOOL FOR HONING AN EXTERNAL SURFACE OF A RIGHT CYLINDRICAL TUBE AND METHOD OF USE

This application claims priority from French Patent Application No. 15 50558 filed Jan. 23, 2015, the contents of all of which are incorporated herein by reference in their entirety.

BACKGROUND OF THE INVENTION

The present invention relates to the field of honing a cylindrical external surface of a rod.

A rod, such as an aircraft landing gear rod, includes cylindrical bearing surfaces such as surfaces for receiving a bearing or a shrunk-on ring, which surfaces present very close dimensional tolerances and require a carefully prepared surface state in order to limit any risk of oxidation points or fatigue crack starter points appearing on the surface.

Tools for honing cylindrical external surfaces make use of honing inserts. By way of example, patent document U.S. Pat. No. 2,474,756 presents a honing tool having:

- a plurality of honing inserts for honing a cylindrical external surface made of metal; and
- a support for the honing inserts, the inserts being carried by the support in such a manner as to define a passage around which the inserts are located and into which it is possible to introduce the cylindrical external surface for honing.

It has been found that such a tool can present risks of damaging the cylindrical external surface during honing.

OBJECT OF THE INVENTION

An object of the invention is to provide a honing tool that is an alternative to the tool described in Document U.S. Pat. No. 2,474,756, and that makes it possible, at least in certain situations, to improve the honing of a cylindrical external surface of a rod.

SUMMARY OF THE INVENTION

For this purpose, the invention provides a honing tool for honing a cylindrical external surface of a rod, the tool comprising:

- a plurality of honing inserts adapted to hone a metal; and
- a support for the honing inserts, the inserts being carried by the support so as to define a passage around which the inserts are to be found and in which it is possible to introduce the cylindrical external surface of the rod.

According to the invention, the tool is essentially characterized in that it includes a plurality of sliding skids carried by the support, the sliding skids and the honing inserts being arranged to be capable of coming simultaneously into contact against the cylindrical external surface of the rod when the rod is placed inside said passage and so as to be able to center the cylindrical external surface inside said passage.

The fact of arranging the sliding skids and the honing inserts so that they can come simultaneously into contact against the cylindrical external annular surface of the rod improves the positioning of the honing inserts relative to said cylindrical surface and limits any risk of vibratory phenomena occurring while the honing insert support is being rotated relative to the rod. Clearance between the cylindrical external surface of the rod and the honing inserts can be limited, thereby correspondingly reducing the deleterious effects associated with vibratory phenomena between the inserts and the rod.

The sliding skids limit the amplitudes of movement between the honing inserts and the cylindrical surface, including during rotation of the insert support around the rod. Since the skids slide on the external surface, they contribute almost nothing to the honing as a result of friction against the skids, with the honing being performed essentially by friction against the honing inserts.

Thus, the tool of the invention enhances uniform honing of the cylindrical external surface.

In a particular embodiment of the invention, at least some of the honing inserts and at least some of the sliding skids form pairs, each of these pairs being formed by a honing insert and a sliding skid placed facing each other on opposite sides of the passage.

Having a sliding skid located facing a honing insert makes it possible to limit any risk of the honing insert moving away from the cylindrical external surface of the rod, thereby correspondingly limiting the amplitude of any vibration between the inserts and the cylindrical external surface of the rod.

Ideally, these pairs are distributed regularly around said passage. Each pair presents a pair orientation axis passing through its honing insert and the corresponding sliding skids. In order to ensure that these pairs are regularly distributed around the passage:

- if there are two pairs, by way of example, then these pair orientation axes are offset by 180°/2, i.e. 90° relative to each other; and
- if there are three pairs, by way of example, then these pair orientation axes are offset by 180°/3, i.e. 60° relative to each other.

Thus, to ensure that these pairs are regularly distributed around said passage, the orientation axes of these pairs are mutually offset by an angle $X=180°/N$, where N is the number of pairs.

In a particular embodiment of the invention, the honing insert support is ring-shaped, the inserts and the skids being located in the ring and facing towards the passage inside the ring. A ring is a shape that serves to stiffen the insert support, thereby enhancing uniform honing.

In a particular embodiment of the invention, each honing insert has a honing surface and each sliding skid presents a sliding surface, these honing and sliding surfaces being shaped to come into contact against the cylindrical external surface of the rod when the rod is placed in the passage, and these honing and sliding surfaces being elongate in a direction parallel to an axis of revolution of the cylindrical external surface of the rod.

By this configuration, the honing and sliding surfaces act throughout honing to provide long centering of the tool on the rod, thereby limiting any geometrical defects generated during honing.

The invention also provides a method of using a tool in accordance with any of the embodiments of the invention for honing a cylindrical external surface of an aircraft landing gear rod.

BRIEF DESCRIPTION OF THE DRAWINGS

Other characteristics and advantages of the invention appear clearly from the following description given by way of non-limiting indication and with reference to the accompanying drawings, in which.

DETAILED DESCRIPTION OF THE INVENTION

Figure 1:
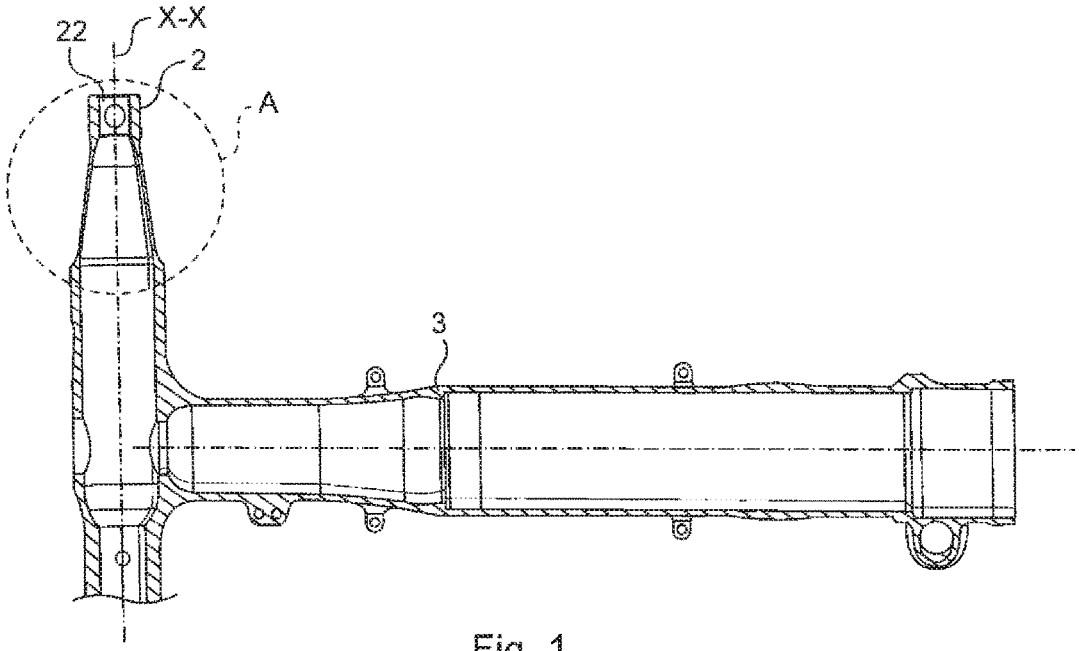
FIG. 1 is a longitudinal section view of an aircraft landing gear rod including a bearing surface presenting a cylindrical external surface for honing.
Figure 2:
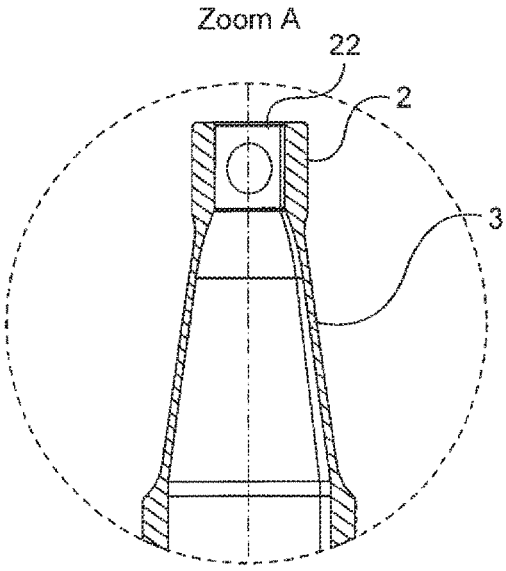
FIG. 2 is a view of detail A in longitudinal section of the bearing surface for honing shown in FIG. 1.
Figure 9:
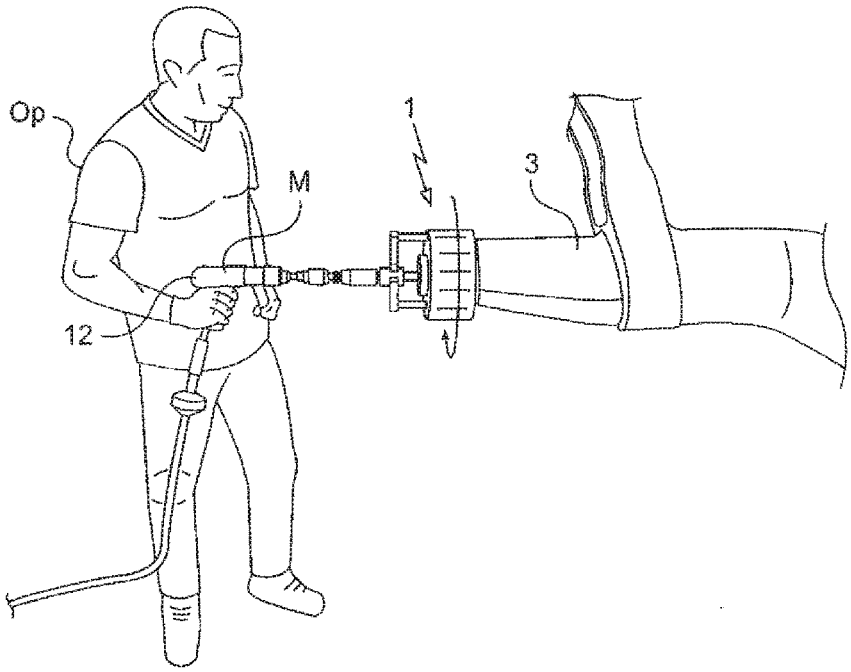
FIG. 9 shows an operator using the portable honing tool of the invention for honing a cylindrical surface of a landing gear rod.

As mentioned above, the invention relates to a honing tool 1 for honing a cylindrical external surface 2 of a rod 3, such as a landing gear rod as shown in FIGS. 1, 2, and 9.

Typically this surface for honing is made of metal and it may comprise a coating of an alloy of nickel and/or chromium and/or carbide. The coating may be deposited electrolytically or by high velocity oxygen fuel (HVOF) spraying.

As can be seen in FIG. 9, the tool 1 is portable and is designed to rotate around the external surface 2 of the stationary rod 3. In order to understand the invention, the term "portable" designates an article weighing less than 15 kilograms (kg) so as to be suitable for being carried manually by an operator. The tool 1 comprises:

- a plurality of honing inserts 4 suitable for honing the metal; and
- a support 5 for these honing inserts, the inserts 4 being carried by the support 5 in such a manner as to define a passage 6 around which the inserts 4 are located and into which it is possible to introduce the cylindrical external surface 2 of the rod 3.

The tool 1 has a plurality of sliding skids 7 typically made of bronze, that are carried by the support 5, which is itself ring-shaped.

The sliding skids 7 and the honing inserts 4 are arranged so that when the cylindrical external surface 2 of the rod 3 is placed inside said passage 6, the inserts and the skids come simultaneously into contact with the surface 2 in order to center the cylindrical external surface 2 inside said passage 6, between the inserts 4.

The tool also has a connection structure 8 between said support 5 and the honing inserts 4 and a drive motor M for driving the insert support in rotation.

Figure 3:
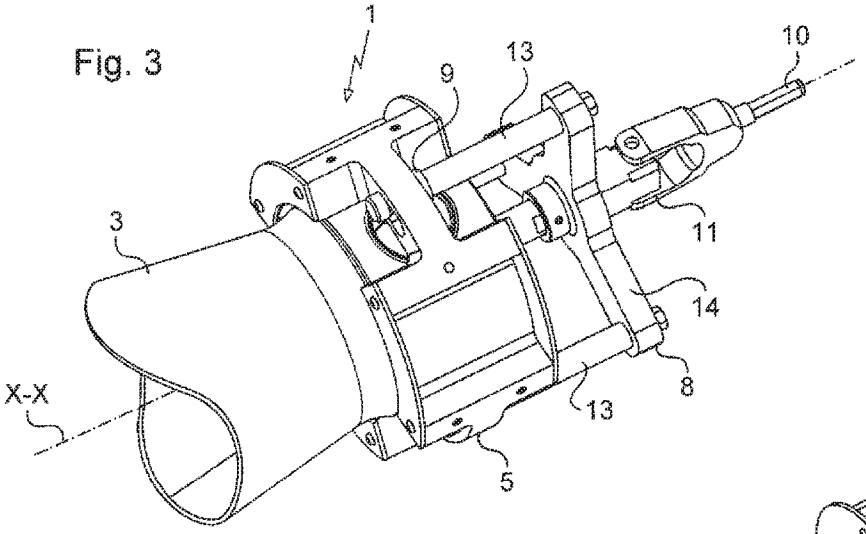
FIG. 3 shows a portion of the rod of FIGS. 1 and 2 with a honing tool of the invention placed around the cylindrical external surface in order to hone it.
Figure 4:
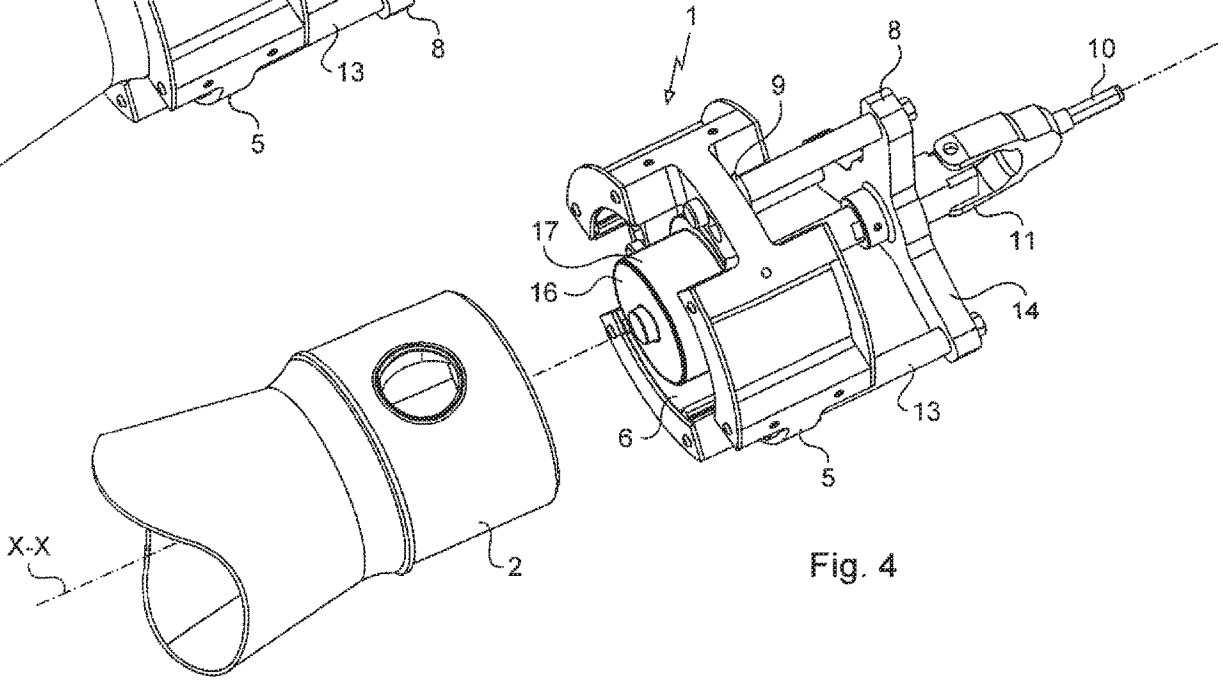
FIG. 4 shows a portion for honing of the rod together with the FIG. 3 tool spaced apart therefrom.
Figure 5:
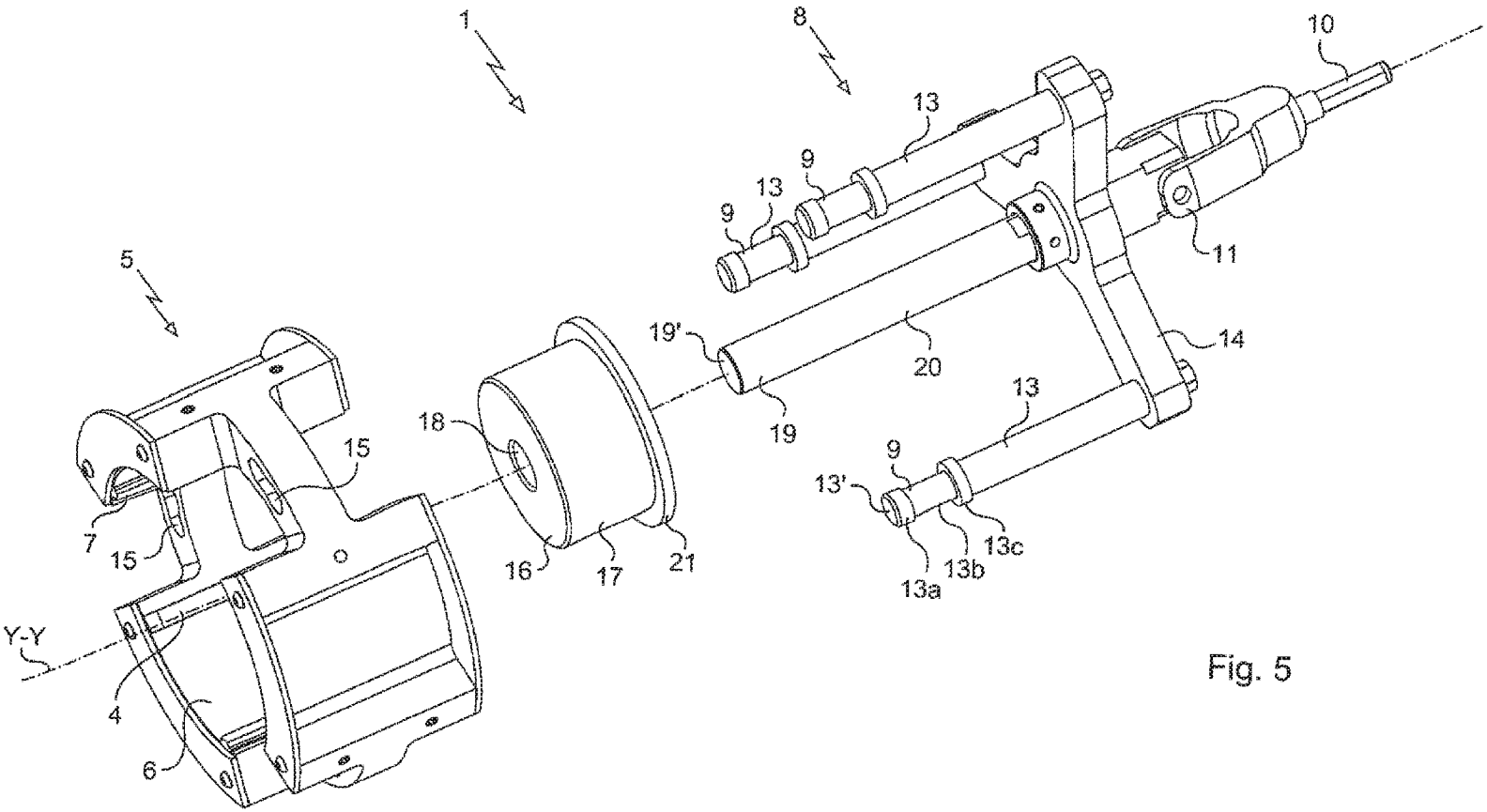
FIG. 5 shows the tool of the invention when partially dismantled.

As can be seen in FIGS. 3, 4, and 5, the connection structure 8 comprises:

- assembly means 9 for assembling the connection structure 8 with the support 5 for the honing inserts 4, the assembly means 9 enabling the connection structure 8 to be selectively disassembled relative to the insert support 5; and
- a drive shaft 10 for driving the connection structure 8 in rotation, the drive shaft 10 being connected to the assembly means 9 via a deformable connection 11 such as a hinge that may be a universal joint.

The drive shaft 10 presents a right cylindrical end of diameter less than 20 millimeters (mm) so as to enable this right cylindrical end to be gripped by a chuck of a portable tool 12 having a drive motor M for rotating the support 5. As can be seen in FIG. 9, the portable tool 12 may be a bolter, e.g. a pneumatic bolter.

The assembly means 9 shown in detail in FIG. 5 comprises a plurality of peripheral pins 13 that are mutually parallel and assembled to a common support part 14 for the peripheral pins, which support part is in the form of a star having three radial branches. As shown in FIGS. 3 and 4, these peripheral pins 13 are arranged to be capable of being positioned together in complementary slots 15 formed in the insert support 5.

The assembly means 9 are such that when assembled with the support 5, the peripheral pins 13 are always constrained to move in translation relative to the insert support 5 in a direction parallel to the peripheral pins 13.

Figure 6:
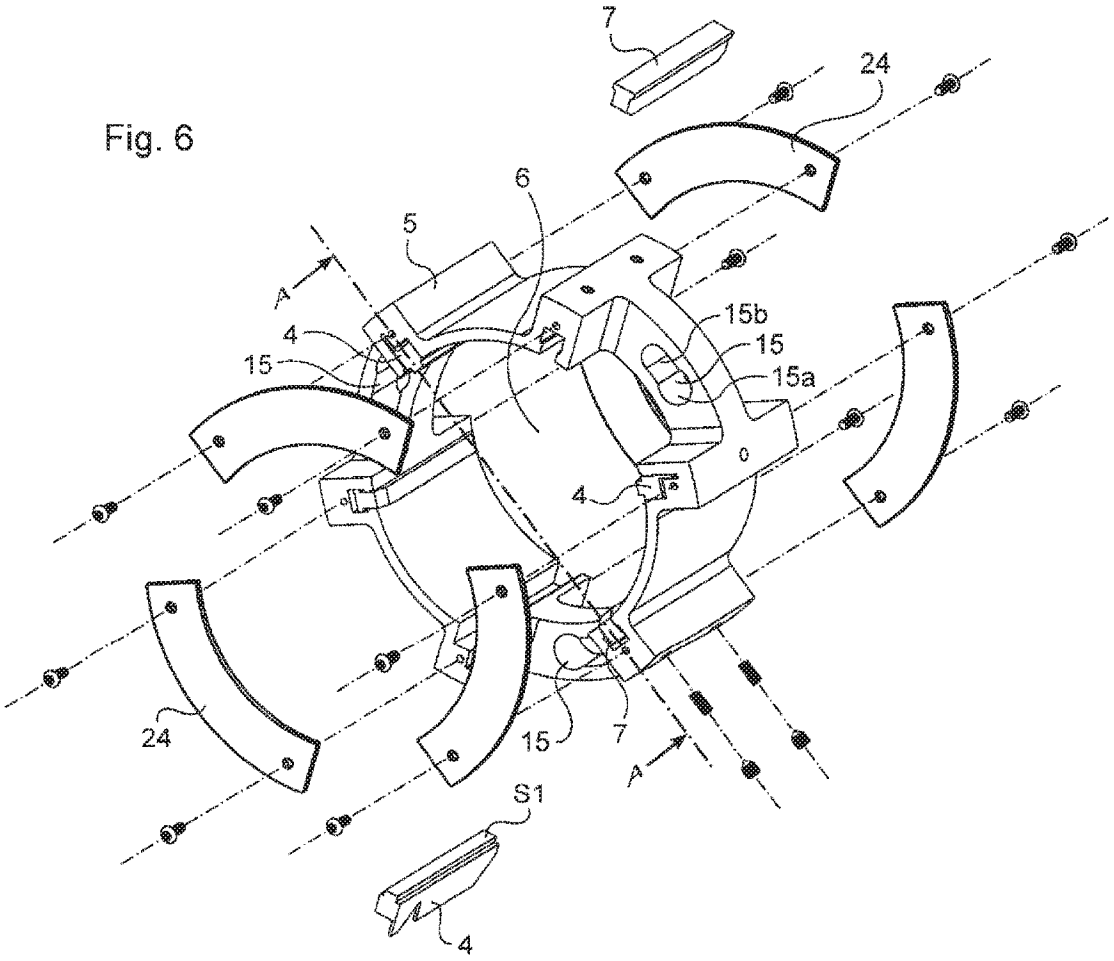
FIG. 6 is an exploded view of the support for honing inserts and sliding skids of the tool of the invention.

More precisely, and as can be seen in FIGS. 5 and 6, each peripheral pin 13 presents lengthwise a terminal portion 13*a* and a proximal portion 13*c* that are of diameter larger than the diameter of an intermediate portion 13*b* between these terminal and proximal portions 13*a* and 13*c*. Each slot 15 presents:

- a first through portion 15*a* extending in planes perpendicular to the axis Y-Y and enabling the terminal and intermediate portions 13*a* and 13*b* to pass through while preventing the proximal portion 13*c* from passing through; and
- a second through portion 15*b* opening out into the first portion and extending in planes perpendicular to the axis Y-Y and along a circular arc centered on Y-Y, being suitable for passing the intermediate portion 13*b* while preventing the terminal and proximal portions 13*a* and 13*c* from passing.

Thus, in order to assemble the connection structure 8 with the support 5, the pins 13 initially have their ends 13' introduced into the corresponding first slot portions 15*a* until the proximal portions 13*c* of these pins 13 come into abutment against an edge of the first slot portion 15*a* and the terminal portions 13*a* project from the first slot portions 15*a*. Thereafter, the connection structure 8 is pivoted by turning about the axis Y-Y so as to cause the intermediate portions 13*b* of the peripheral pins 13 to penetrate into the corresponding second slot portions 15*b*. This achieves assembly since each of the edges of the slots 15 is then held between the portions 13*a* and 13*c* of a corresponding one of these peripheral pins 13. Disassembly can be achieved by pivoting the connection structure 8 in the opposite direction relative to the support 5 and then by withdrawing the structure 8 along the axis Y-Y.

Ideally, if the rod 3 presents a cylindrical internal surface 22 that is coaxial with its cylindrical external surface 2, as in the embodiment shown, then prior to assembling the connection structure 8 with the honing insert support 5, it is possible to position a centering part 16 inside the rod 3 so as to be centered by coming into contact with the cylindrical internal surface 22. This centering part 16 presents an external surface of revolution 17 extending along a main axis of symmetry Y-Y of the passage. The centering part 16 also has an annular shoulder 21 adapted to limit the extent to which the centering part can be engaged into the rod.

Mechanical means described below enable the honing insert 4 and the sliding skids 7 to be positioned so that all of them can extend along this main axis of symmetry Y-Y of the passage 6 and parallel to this main axis of symmetry, these honing inserts 4 and skids 7 all being spaced apart from the external surface of revolution 17 and all being at the same distance from this external surface of revolution 17.

The centering part 16 enables the rod 3 to be centered twice over, firstly via the honing inserts 4 and the sliding skids 7 pressing against the cylindrical external surface 2 of the rod, and secondly via the centering part 6, which presses against a cylindrical internal surface 22 of the rod 3.

As can be seen in FIG. 5, the centering part 16 presents a through internal bore 18 that extends along the main axis of symmetry Y-Y of the passage.

The tool 1 also has a centering pin 19 that extends inside the internal bore 18 in order to provide a rotary-sliding connection of the centering part 16 along the centering pin 19, this centering part 16 being removable from the centering pin 19.

This facilitates the step of assembling the connection structure 8 with the support 5, since the operator Op can begin by positioning the insert support 5 around the surface 2 of the rod, and can then position the part 16 inside the rod 3 so that the cylindrical external surface 17 comes into contact against the cylindrical internal surface 22 of the rod.

Thereafter, the operator Op can pre-position the centering pin 19 relative to the bore 18 formed in the centering part 16, thereby also pre-positioning the connection structure 8 relative to the rod 3 and relative to the support 5.

The centering pin 19 presents an annular surface 20 of right cylindrical shape for passing inside the internal bore 18 in the centering part 16 so that the centering part 16 is capable of rotating relative to the centering pin 19 and can slide along the centering pin 19.

The centering pin 19 is placed at equal distances from the peripheral pins 13 and it is parallel to the peripheral pins 13. The centering pin 19 is assembled on the same support part 14 as the peripheral pins 13 so that the peripheral pins 13 and the centering pin 19 co-operate with the support part 14 to form a non-deformable mechanical structure.

The centering pin 19 presents a length such that its terminal end 19' extends beyond the respective ends 13' of the peripheral pins 13.

This enables the centering pin 19 to penetrate in the bore 18 of the centering part 16 before the peripheral pins 13 come into contact with the support 5 for the insert 4. The connection structure 8 is thus pre-guided by the centering part 16, thereby limiting any risk of damaging the rod while assembling together the connection structure 8 and the insert support 5.

Figure 7:
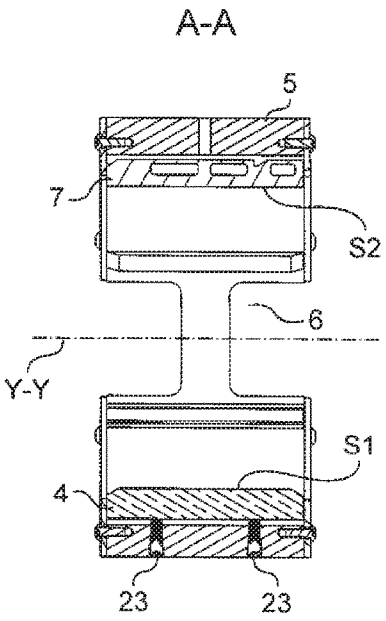
FIG. 7 is a cross-section view of the honing insert support of FIG. 6, and in this view there can be seen a pair formed by a honing insert and a sliding skid facing each other.

As can be seen in FIGS. 3, 6, and 7, the honing surfaces S1 and the sliding surfaces S2 are shaped to come into contact against the cylindrical external surface 2 of the rod 3 introduced in the passage 6. As shown in FIG. 7, it is possible to provide means for adjusting the distance between the sliding skid 7 and one of the honing inserts 4. These means for adjusting distance may be screws 23 threaded through the support 5 so as to be capable, on being tightened, of moving the insert 4 so as to reduce the diameter of the passage 6. These adjustment screws 23 also make it possible to determine the pressing force applied by a skid 7 or by an insert 4 against the rod.

It is also possible to use means for moving the guide skids relative to the ring-shaped support 5 in order to force them against the surface 2 of the rod.

Figure 8:
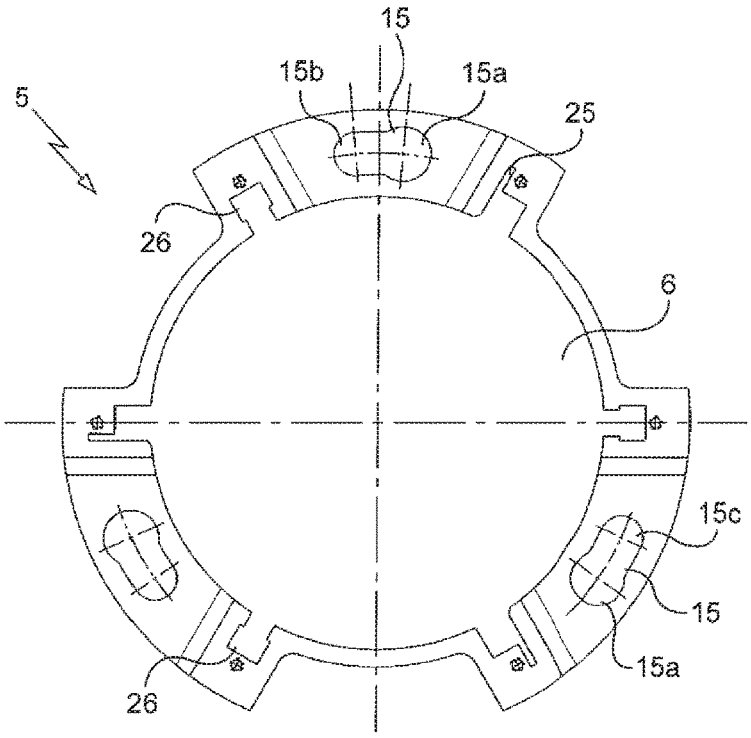
FIG. 8 shows the honing insert support seen in a direction parallel to the main axis of symmetry Y-Y of the passage through the insert support.

As can be seen in FIGS. 6, 7, and 8, the inserts 4 are bar-shaped and each of them presents a guide plate for guiding the insert laterally relative to the support 5. Each plate is introduced in a corresponding radial slot 25 formed in the support 5 and facing towards the axis of symmetry Y-Y of the passage 6. Each insert is thus radially movable with guidance between the slot and the plate.

Each skid 7 is T-shaped and is placed in a corresponding T-shaped groove 26 formed in the support 5.

End plates 24 are placed on both ends of the ring shape to prevent the inserts 4 and the skids 7 sliding out from the slots 25 and grooves 26 along a Y-Y direction.

Each honing insert 4 has a honing surface S1 and each sliding skid 7 presents a sliding surface S2, these honing and sliding surfaces S1 and S2 being shaped so as to come into contact against the cylindrical external surface 2 of the rod 3 when the rod is placed in the passage 6.

Each of the honing surfaces S1 then presents friction in sliding against a complementary metal surface 2 with a first coefficient of friction in sliding.

Each of these sliding surfaces S2 then presents friction in sliding against said complementary metal surface with a second coefficient of friction in sliding. The first coefficient of friction is at least three times greater than the second coefficient of friction.

Such coefficients of sliding friction can be measured in application of Coulomb's law of friction, in which:

$$T=N\tan\phi=Nf$$

where:

- $f=\tan\phi$ is the coefficient of friction in sliding of a honing surface or of a sliding surface on a complementary surface, made of steel in this example;
- N is the pressing force exerted by the honing surface or the sliding surface against the complementary metal surface made of steel (this component N is normal to the complementary metal surface against which the sliding friction is taking place);
- T is the friction force that opposes sliding; and
- $\phi$ is the angle formed between the force vector N and the force vector T.

Figure 10:
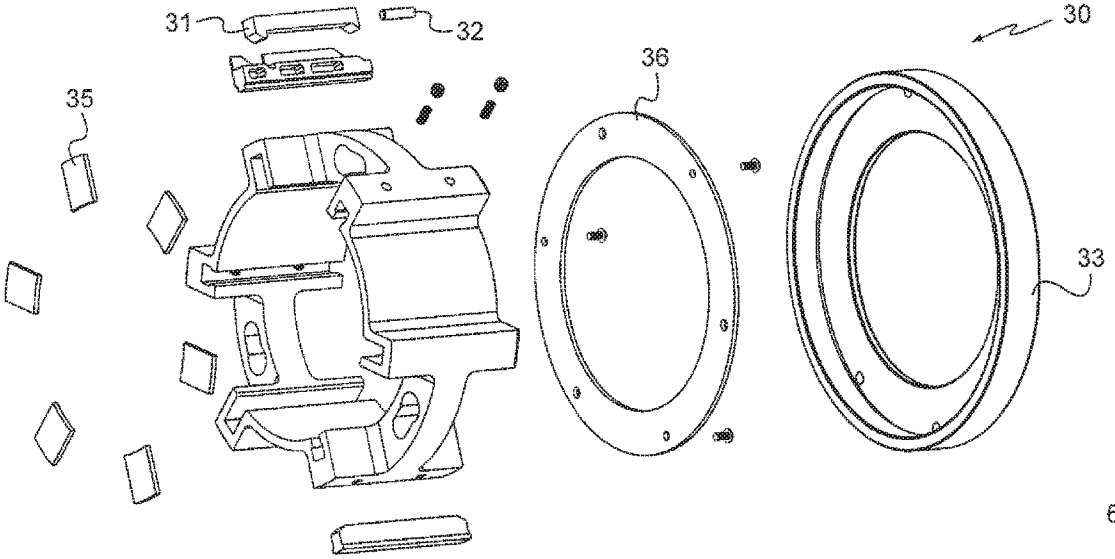
FIG. 10 is an exploded view of the honing tool of the invention in an embodiment that includes means for causing the honing inserts to be moved simultaneously relative to said passage.
Figure 11:
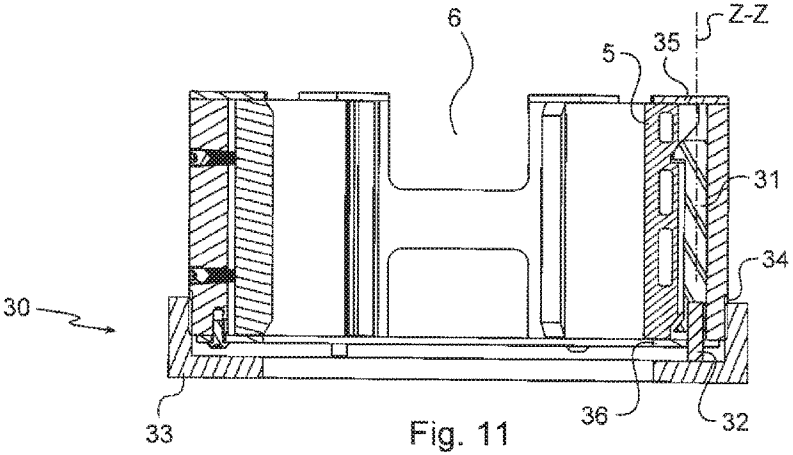
FIG. 11 is a cross-section view of the honing tool shown in FIG. 10 once it is assembled.

In a preferred embodiment as shown in FIGS. 10 and 11, the honing insert support 5 has control means 30 for causing the honing inserts to move simultaneously relative to said passage 6. During this simultaneous movement, each of the honing inserts 4 moves radially relative to the axis Y-Y and consequently relative to the passage 6.

For this purpose, the control means 30 comprise a plurality of sliders 31 and a control ring 33.

Each slider 31 in this plurality of sliders is in contact against a corresponding one of the honing inserts 4 so that movement of the slider 31 along a main slider axis Z-Z causes the corresponding honing insert 4 to move radially relative to said passage 6. It should be observed that the radial movement of an insert takes place perpendicularly to the axis Y-Y. Contact between a slider and the corresponding honing insert takes place via two uniform cams formed on a rear portion of the honing insert and via two complementary uniform cams formed on a front portion of the slider. These four cams act together so that when the slider 31 is moved axially along its axis Z-Z, the insert is moved in translation along a radial axis relative to the passage 36, and consequently relative to the axis Y-Y.

The control ring 33 is threaded and engages a complementary thread 34 so as to enable the control ring 33 to be moved along a ring threading axis that is perpendicular to each of the main axes Z-Z of the sliders 31.

The ring 33 is mechanically connected to said sliders 31 via pushers 32, so that movement of the control ring 33 relative to its threading axis causes the sliders 31 to move along their respective slider axes Z-Z.

Simultaneous movement of the sliders 31 causes the honing inserts 4 to move simultaneously relative to said passage 6 concentrically about the axis Y-Y.

Plates 35 are arranged at one end of the honing inserts so as to form axial abutments serving to guide the radial movement of each of the honing inserts 4.

A disk 36 is located at the other ends of the honing inserts 4 serving likewise to guide this radial movement.

This embodiment makes it possible, merely by tightening the ring 33, to position all of the honing inserts relative to the sliding skids.

The invention also provides a method of honing a cylindrical external surface 2 of an aircraft landing gear rod 3 by using the tool of the invention.

In the method, the landing gear rod 3 is held stationary and then the support 5 for the honing insert 4 is put into position around the cylindrical external surface 2 of the rod 3 in such a manner that the guide skids 7 and the honing inserts 4 press against the cylindrical external surface 2 of the rod.

The skids slide against the cylindrical external surface of the rod and center the tool 1 together with the honing inserts 4 relative to the cylindrical external surface 2.

Thereafter, using the assembly means 9 of the connection structure 8, the connection structure is assembled with the honing insert support. Optionally, prior to assembling the connection structure 8 with the honing insert support 5, it is possible to position the centering part 16 in the bore formed in the rod, against the annular cylindrical internal surface 22 that is coaxial with the cylindrical external surface 2.

By introducing the centering pin 19 of the structure 8 in the bore 18 in the centering part 16, the centering pin 19 of the structure 8 is pre-positioned relative to the rod 3 and the movement of the peripheral pin 13 relative to the support 5 is guided along the axis Y-Y. This makes it easier to position the end 13' of the peripheral pin 13 in the complementary slots 15 in the support 5.

Once assembly has been completed and the drive motor M has been coupled to the shaft 10, the connection structure of the tool 1 is driven in rotation. The honing tool 1 as driven in rotation in this way relative to the rod 3 is guided by the skids sliding on the surface 2, while the inserts 4 hone the metal cylindrical external surface 2 of the landing gear rod.

It should be observed that resilient means may be used for opposing centrifugal movement of the sliding skids. Such an embodiment may be used for maintaining some minimum value for the pressing force and consequently for determining:

the intensity of the friction force of the inserts against the rod; and the intensity of the honing.

The invention claimed is:

1. A honing tool (1) for honing a cylindrical external surface (2) of a rod (3), the tool comprising:

a plurality of honing inserts (4) adapted to hone a metal; and a support (5) for the honing inserts, the inserts (4) being carried by the support (5) so as to define a passage (6) around which the inserts (4) are to be found and in which it is possible to introduce the cylindrical external surface (2) of the rod (3);

wherein the tool (1) includes a plurality of sliding skids (7) carried by the support (5), the sliding skids (7) and the honing inserts (4) being arranged to be capable of coming simultaneously into contact against the cylindrical external surface (2) of the rod (3) when the rod is placed inside said passage (6) and so as to be able to center the cylindrical external surface (2) inside said passage (6), and wherein the tool further includes a connection structure (8) between said support (5) for supporting the honing inserts (4) and a drive motor (M) for rotating the insert support, the connection structure (8) comprising:

assembly means (9) for assembling the connection structure (8) with the support (5) for the honing inserts (4), the assembly means (9) allowing the connection structure (8) to be disassembled from the insert support (5); and a drive shaft (10) for rotating the connection structure (8), the drive shaft (10) being connected to the assembly means (9) via a deformable connection (11), the honing tool further including a centering part (16) presenting an external surface of revolution (17) extending along a main axis of symmetry (Y-Y) of the passage, the honing inserts (4) and the sliding skids (7) extending along the main axis of symmetry (Y-Y) of the passage and parallel to the main axis of symmetry, and wherein the honing inserts (4) and the sliding skids (7) all being spaced apart from the external surface of revolution (17) and at equal distances from said external surface of revolution (17), the centering part (16) presenting a through internal bore (18) extending along the main axis of symmetry (Y-Y) of the passage, the tool further including a centering pin (19) extending inside the through internal bore (18) of the centering part (16) in order to provide a rotary and sliding connection for the centering part (16) along the centering pin (19), the centering part (16) being separable from the centering pin (19).

2. The honing tool (1) according to claim 1, wherein at least some of the honing inserts (4) and at least some of the sliding skids (7) form pairs, each of these pairs being formed by a honing insert (4) and a sliding skid (7) placed facing each other on opposite sides of the passage (6).

3. The honing tool according to claim 2, wherein these pairs are distributed regularly around said passage (6).

4. The honing tool according to claim 1, wherein the support (5) is ring-shaped.

5. The honing tool according to claim 1, wherein each honing insert (4) has a honing surface (S1), and each sliding slid (7) presents a sliding surface (S2), these honing and sliding surfaces (S1, S2) being shaped to come into contact against the cylindrical external surface (2) of the rod (3) when the rod is placed in the passage (6), and these honing and sliding surfaces (S1, S2) being elongate in a direction parallel to an axis of revolution (X-X) of the cylindrical external surface of the rod (2).

6. The honing tool according to claim 1, wherein:

each honing insert (4) has a honing surface (S1) and each sliding skid (7) presents a sliding surface (S2), the honing and sliding surfaces (S1, S2) being shaped to come into contact against the cylindrical external surface (2) of the rod (3) when the rod is placed in the passage (6);

during sliding friction against a complementary metal surface (2), each of the honing surfaces (S1) presents a first coefficient of friction in sliding; and during sliding friction against a complementary metal surface, each of the sliding surfaces (S2) presents a second coefficient of friction in sliding, the first coefficient of friction being at least three times greater than the second coefficient of friction.

7. The honing tool according to claim 1, wherein the drive shaft (10) for rotating the connection structure (8) presents a right cylindrical end of diameter less than 20 mm so as to enable the right cylindrical end to be gripped by a chuck of a portable tool (12) having a motor (M) for driving rotation of the support (5) of the inserts (4).

8. The honing tool according to claim 1, wherein the assembly means (9) comprise a plurality of peripheral pins (13) that are mutually parallel and that are assembled to a common support part (14) for these peripheral pins, the peripheral pins (13) being arranged so as to be capable of being positioned together in complementary slots (15) formed in the insert support (5) and these assembly means (9) being such that when they are assembled with the insert support (5), the peripheral pins (13) are constrained to move in translation relative to the insert support and in a translation direction that is parallel to the peripheral pins (13).

9. The honing tool according to claim 1, wherein the honing insert support (5) includes control means (30) for causing the honing inserts to move simultaneously relative to said passage (6).

10. A method comprising:

using a tool according to claim 1 for honing a cylindrical external surface (2) of an aircraft landing gear rod (3).

11. The method according to claim 10, wherein the landing gear rod (3) is held stationary and then the support (5) supporting honing inserts (4) is put into position around the cylindrical external surface (2) of the rod (3) so that the guide skids (7) and the honing inserts (4) press against the cylindrical external surface (2) of the rod, and then the assembly means (9) of the connection structure (8) are used to assemble the connection structure with the honing insert support, and a drive motor (M) coupled to the rotary drive shaft of the connection structure is used to drive the honing tool in rotation relative to the rod so as to hone the cylindrical external surface of the landing gear rod that is being held stationary.

* * * * *